United States Patent [19]

Intengan

[11] Patent Number: 4,671,031

[45] Date of Patent: Jun. 9, 1987

[54] THREE DIMENSIONAL PROTECTIVE PANEL FOR WINDOW OR DOOR PANE

[76] Inventor: Franklin S. Intengan, 17831 NW. 79th Pl., Palm Springs, North, Fla. 33015

[21] Appl. No.: 851,577

[22] Filed: Apr. 14, 1986

Related U.S. Application Data

[63] Continuation-in-part of Ser. No. 789,340, Oct. 21, 1985, abandoned.

[51] Int. Cl.[4] ..... E06B 3/28; E04C 2/32

[52] U.S. Cl. ..... 52/203; 52/309.1; 52/792

[58] Field of Search ..... 52/203, 792, 309.1

[56] References Cited

U.S. PATENT DOCUMENTS

| | | | |
|---|---|---|---|
| 908,353 | 10/1862 | Gutwein | 20/3 |
| 3,121,977 | 2/1964 | Bersudsky | 52/792 X |
| 3,421,259 | 1/1969 | Egan, Jr. | 49/62 |
| 3,568,390 | 3/1975 | Swensen et al. | 52/792 |
| 3,760,541 | 9/1973 | Fulcher | 52/203 |
| 3,831,319 | 8/1974 | Warner | 49/62 |
| 4,198,796 | 4/1980 | Foster | 52/203 |

FOREIGN PATENT DOCUMENTS

| | | | |
|---|---|---|---|
| 450362 | 10/1927 | Fed. Rep. of Germany | 52/337 |
| 1039300 | 5/1953 | France | 52/337 |
| 2335662 | 7/1977 | France . | |

*Primary Examiner*—Alfred C. Perham
*Attorney, Agent, or Firm*—Oltman and Flynn

[57] ABSTRACT

A protective panel for attachment to a window or door pane. The panel is a molded one-piece body of suitable transparent plastic material with a peripheral rim having a flat adhesive-covered face for attachment to the window pane. Inside this rim the panel has adjoining inclined flat segments extending laterally inward from the rim at a substanial angle to the plane of the adhesive-covered face of the rim. Additional segments of the panel close the space inside the inclined flat segments.

4 Claims, 11 Drawing Figures

FIG. 1
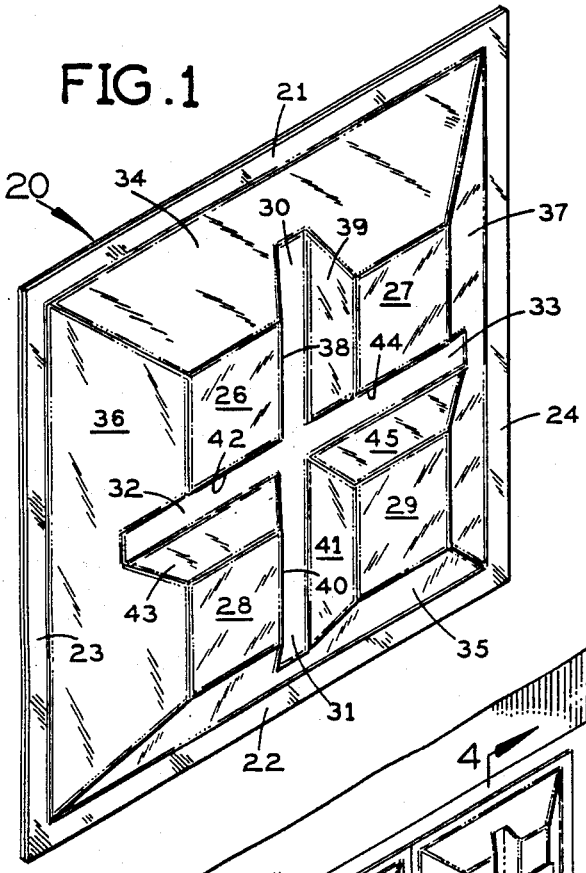
FIG. 2
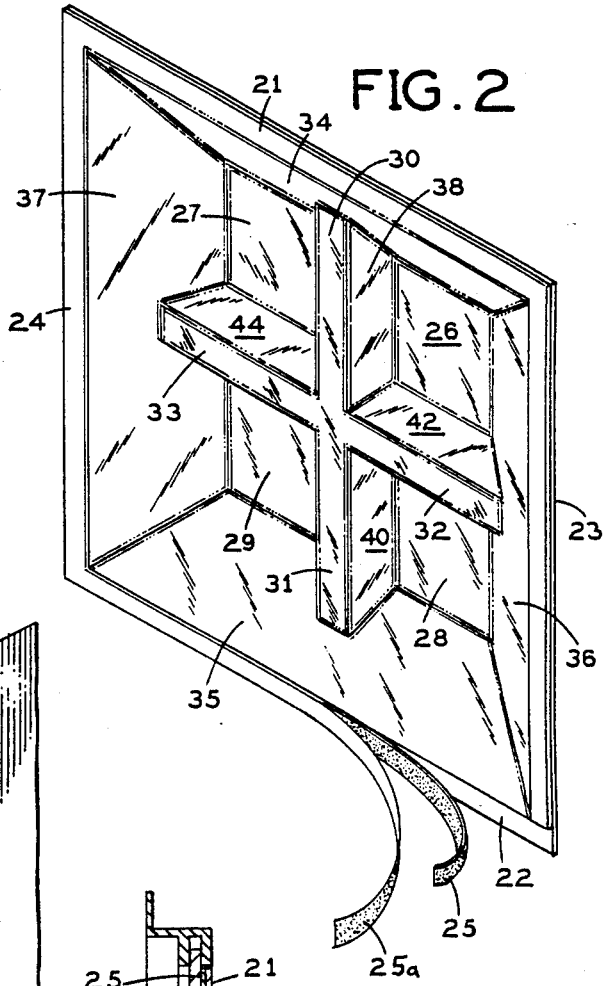
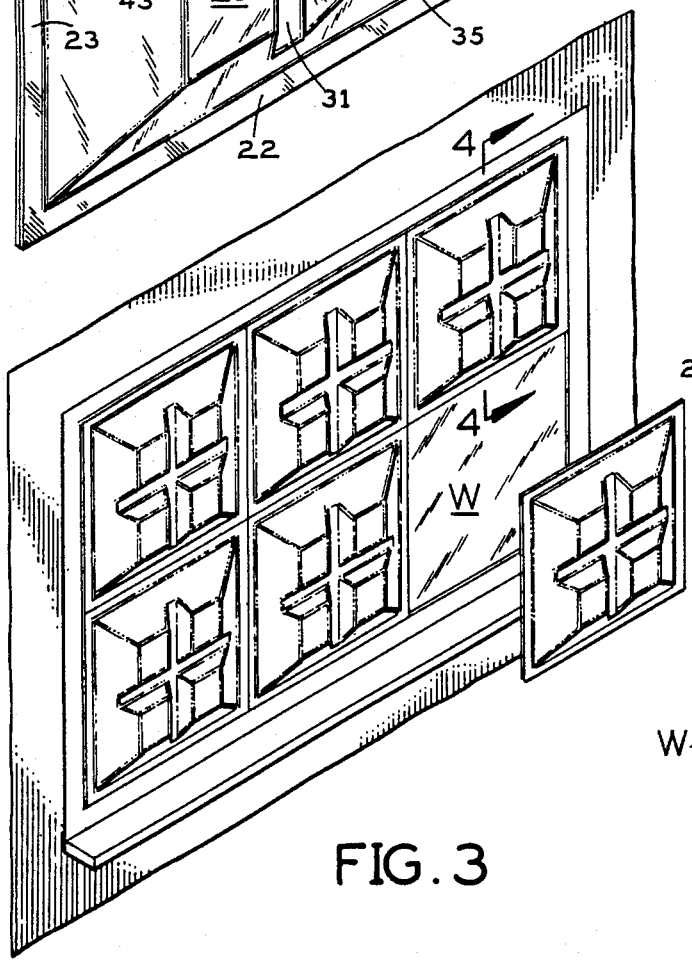
FIG. 3
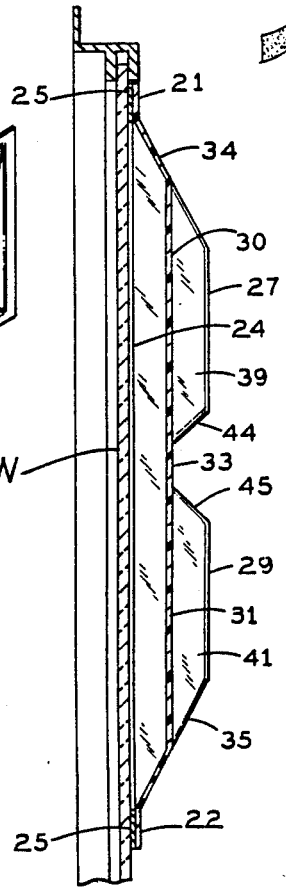
FIG. 4

THREE DIMENSIONAL PROTECTIVE PANEL FOR WINDOW OR DOOR PANE

CROSS-REFERENCE TO RELATED APPLICATION

This application is a continuation-in-part of my copending U.S. patent application Ser. No. 789,340, filed Oct. 21, 1985, now abandoned for THREE DIMENSIONAL WINDOW OR DOOR PANEL SHIELD.

SUMMARY OF THE INVENTION

This invention relates to a protective panel for adhesive attachment to a glass window or door pane to protect it from breakage and provide a heat insulating effect without preventing ambient light from reaching the window pane.

The present panel is readily attachable to a glass window or door pane, such as in the event of an approaching hurricane or storm for which a home owner will want to complete his or her preparations quickly and without undue physical exertion. An important feature of this panel is that it is attached to the window or door panel only at its own peripheral rim, which greatly simplifies putting it on a window pane while making it possible to provide a heat-insulating dead air space between the panel and the window or door pane. The panel has adjoining inclined flat segments which extend laterally inward from its peripheral rim at a substantial acute angle and additional segments which close the space between the inclined flat segments. Much of the surface area of the panel at these additional segments is parallel or almost parallel, to the window or door pane to minimize optical distortion. The panel is sufficiently transparent to light that it does not bother persons inside the building who are conscious of the illumination from outdoors. If desired, the panel may be composed of a material which filters out certain invisible components of sunlight while transmitting the visible wavelengths with no deleterious attenuation.

A principal object of this invention is to provide a novel protective panel for attachment to a glass window or door pane.

Another object of this invention is to provide such a panel which can be quickly and easily attached to the window or door pane and after attachment provides thermal insulation across the window or door pane.

Other objects of the invention will appear from the following description of several presently preferred embodiments shown in the accompanying drawings.

DESCRIPTION OF THE DRAWINGS

FIG. 1 is a perspective view of a first embodiment of the present panel taken from the outer side, i.e., the side away from the window pane on which it is to be mounted;

FIG. 2 is a perspective view of this panel taken from the opposite side, i.e., the side toward the window pane;

FIG. 3 is a perspective view showing five of these panels on a window pane with a sixth panel ready to be put on to finish covering the window pane;

FIG. 4 is a vertical cross-section taken along the line 4—4 in FIG. 3 and showing one of these panels on the window pane;

FIG. 10 is a perspective view of a fourth embodiment of the present panel; and .

Figure 5:
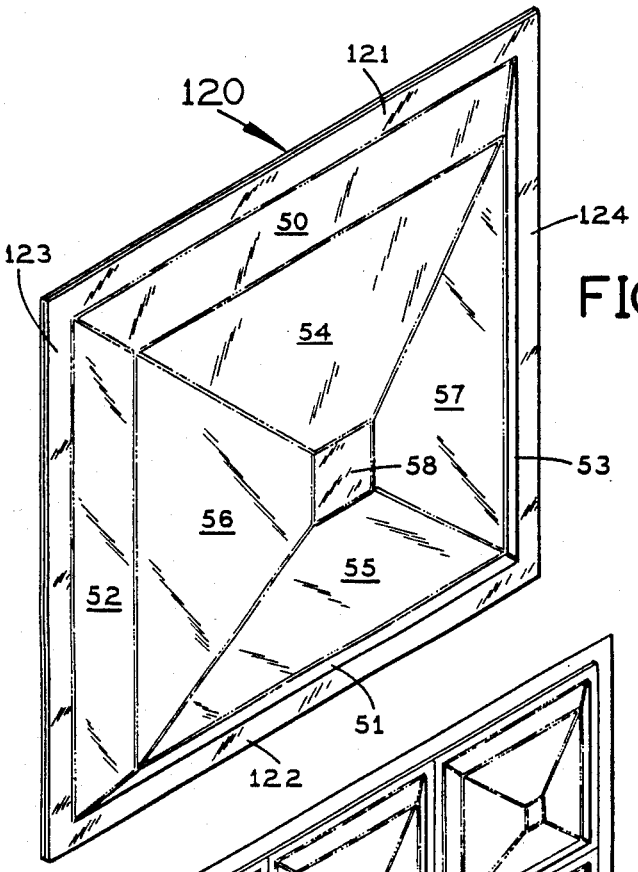
FIG. 5 is a perspective view of a second embodiment of the present panel.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIGS. 1–4, the panel has a rectangular outline defined by a thin flat peripheral rim 20 made up of a horizontally elongated top segment 21, a horizontally elongated bottom segment 22 extending parallel to the top segment, and parallel, vertically elongated, opposite side segments 23 and 24 extending down from the top segment to the bottom segment at opposite ends of each.

The horizontal and vertical dimensions of the panel are such that six of them will completely cover a glass window pane W, as shown in FIG. 3, with three of the panels extending in succession contiguous to one another across the top half of the window pane and three across the bottom half. It is to be understood that this is just one possible arrangement and that the present panel may be manufactured in different sizes to fit different windows.

The segments 21, 22, 23 and 24 of the panel rim have flat, coplanar inside faces that will fit next to the outside face of the window pane W. As shown in FIG. 2 for the bottom segment 22 of the rim, the flat inside face of each rim segment is covered by a thin self-adhesive layer 25 which is adhesive or sticky on both sides, one of which adheres permanently to the corresponding segment of the rim of this panel and the other of which is covered by a protective peel-off strip 25*a*. Preferably, the adhesive layer 25 is a pressure-sensitive adhesive. This peel-off strip is removed just before the panel is put on a window pane.

Except at its peripheral rim 20 the entire panel is displosed completely on the opposite side of the rim 20 from its window pane-engaging inside face.

As best seen in FIG. 1, the panel presents four discrete, flat, rectangular outer segments 26, 27, 28 and 29 lying in a plane parallel to the plane of the adhesive-coated inside face of the peripheral rim 20. Between the outer flat segments the panel presents four interconnected flat inner segments 30, 31, 32 and 33 lying in a plane parallel to the plane of the outer segments 26, 27, 28 and 29 and closer than the latter plane to the peripheral rim 20. Inner segment 30 is between the upper outer segments 26 and 27 and is substantially narrower than either of them horizontally. Similarly, inner segment 31 is between the lower outer segments 28 and 29 and is substantially narrower than either of them horizontally. Inner segment 32 is between the left-hand outer segments 26 and 28 and is substantially narrower than either of them vertically. Inner segment 33 is between the right-hand outer segments 27 and 29 and is substantially narrower than either of them vertically. The inner segments 30, 31, 32 and 33 intersect at the center of the panel between the four outer segments 26, 27, 28 and 29.

Toward the top the panel presents a flat inclined upper segment 34 which extends down and out at an angle of about 45 degrees to the plane of the peripheral rim 20 from the top segment 21 of the rim to the top edges of the upper outer segments 26 and 27 and the inner segment 30 between them. Toward the bottom the panel presents a flat inclined lower segment 35 which extends up and out at an angle of about 45 degrees to the plane of the peripheral rim 20 from the bottom segment 22 of the rim to the bottom edges of the lower outer segments 28 and 29 and the inner segment 31 between them. Near its left side in FIG. 1 the panel presents a flat inclined segment 36 which extends laterally inward and out at an angle of about 45 degrees to the plane of the peripheral rim 20 from the left side segment 23 of the rim to the left edges of the outer segments 26 and 28 and the inner segment 32 between them. Near its opposite side the panel presents a flat inclined segment 37 which extends laterally inward and out at an angle of about 45 degrees to the plane of the peripheral rim 20 from the right side segment 24 of the rim to the right edges of the outer segments 27 and 29 and the inner segment 33 between them.

On opposite sides of the inner segment 30 a flat inclined segment 38 extends from it at an angle of about 45 degrees to the adjacent inner edge of the upper outer segment 26, and a flat inclined segment 39 extends from it at an opposite angle of about 45 degrees to the adjacent inner edge of the other upper outer segment 27. A flat inclined segment 40 extends out from one side of the inner segment 31 at an angle of about 45 degrees to the adjacent inner edge of the lower outer segment 28 and a flat inclined segment 41 extends out from the opposite side of inner segment 31 at an opposite angle of about 45 degrees to the adjacent inner edge of the other lower outer segment 29. Above the inner segment 32 a flat inclined segment 42 extends up and out from it at an angle of about 45 degrees to the adjacent top edge of outer segment 26, and below this inner segment a flat inclined segment 43 extends down and out at an angle of about 45 degrees to the adjacent top edge of lower segment 28. Above the remaining inner segment 33 a flat inclined segment 44 extends up and out from it at an angle of about 45 degrees to the adjacent bottom edge of outer segment 27, and below this inner segment a flat inclined segment 45 extends down and out at an angle of about 45 degrees to the adjacent top edge of outer segment 29.

The inclined flat segments 34, 35, 36 and 37 form sharp corners with the outer segments 26, 27, 28 and 29 and the inner segments 30, 31, 32 and 33 of the panel. Together these corners form an inner border on the panel which is located latereally inward from the peripheral rim 20. The space inside this inner border is closed by the outer segments 26–29, the inner inclined segments 38–45 and the inner segments 30–33. Much of the surface area inside this inner border is taken up by the outer segments 26–29 and the inner segments 30–33 all of which extend parallel to the plane of the peripheral rim 20 and parallel to the window pane W to minimize optical distortion.

The inner segments 30, 31, 32 and 33 and the oppositely inclined connecting segments 38, 39, 40, 41, 42, 43, 44 and 45 together form grooves between the flat outer segments 26, 27, 28 and 29 which have the bottoms of the grooves (provided by the inner segments 30, 31, 32 and 33) lying in a plane closer than the plane of the outer segments 26, 27, 28 and 29 to the plane of the inner face of the peripheral rim 20 of the panel.

FIG. 4 shows in detail how one of the panels fits against a glass window pane W, with only the adhesive layer 25 on the inside face of the peripheral rim 20 of the panel engaging the window pane and providing an air-tight seal around the entire periphery of the panel. Except at the rim the entire panel is away from the window pane and it forms a single pocket for holding "dead" air which acts as a heat insulator.

The entire panel preferably is molded in one piece from a suitable plastic material which is substantially transparent to the visible wavelengths of light, has high heat insulation properties, is strong enough to resist cracking or breaking, and does not change significantly in appearance after exposure to sunlight and the weather. Preferably, the material of the panel is cellulose acetate butyrate which is stable to ultra-violet light and is not unduly expensive. Preferably, also, the panel has a thickness of about 0.030 inch throughout.

The second embodiment of the present panel (FIGS. 5–7) is similar to the first in that it has the same type of marginal rim, corresponding elements of which are given the same reference numerals plus 100 as those in FIGS. 1–4, so that the detailed description of these parts need not be repeated.

Figure 6:
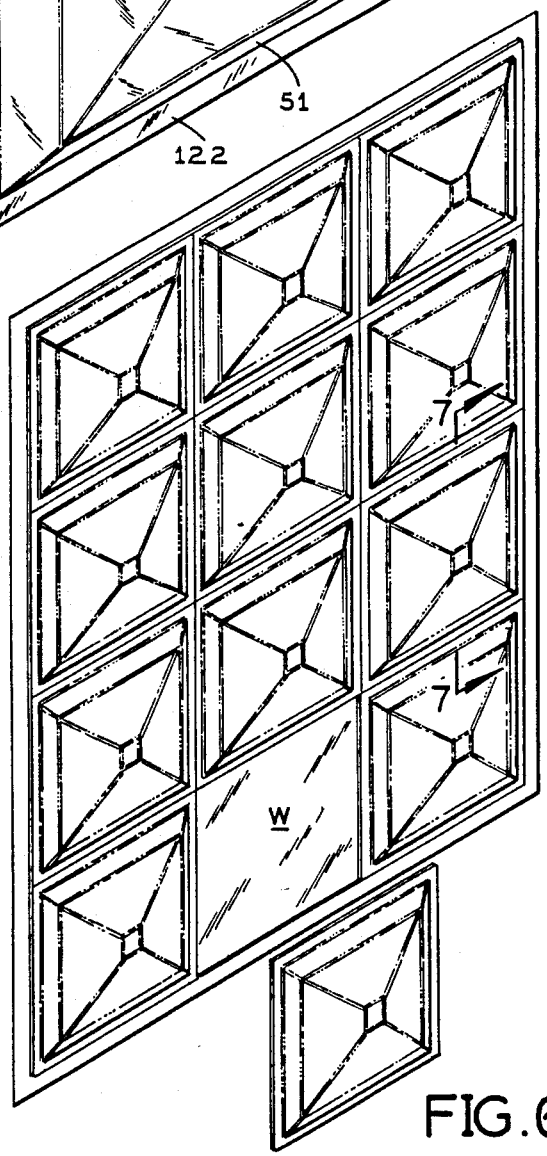
FIG. 6 is a perspective view showing several of these panels on a window pane, with a final panel ready to be put on to complete the coverage of this window pane.
Figure 7:
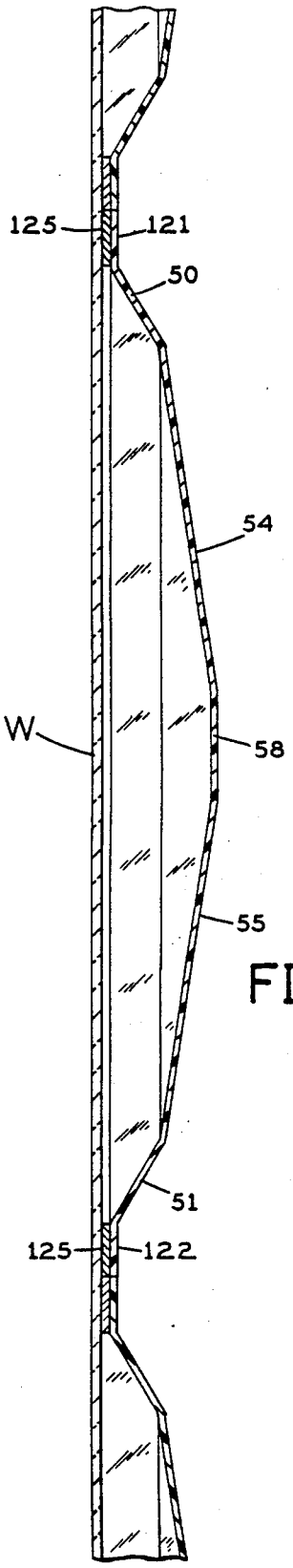
FIG. 7 is a vertical cross-section taken along the line 7—7 in FIG. 6.

Except at this peripheral rim 120 the entire panel in FIGS. 5–7 is disposed on the oppsite side of the rim from where it engages the window pane W.

Just inward from the rim 120 the panel presents an inclined flat upper segment 50 and an oppositely inclined flat lower segment 51, an inclined flat left side segment 52 and an oppositely inclined flat right-side segment 53. These inclined segments are joined respectively to the top, bottom and side segments of the rim 120 and extend laterally inward from the respective rim segments at a substantial acute angle to the plane of the rim 120, such as 30 degrees or more.

Just inward from the outer inclined segments 50, 51, 52 and 53 the panel presents inner inclined segments 54, 55, 56 and 57, each extending at a very small acute angle to the plane of the rim 20 and the plane of the window pane W (FIG. 7). The inclined segments 54, 55, 56 and 57 converge toward the center of the panel and are joined to a flat, central, outer segment 58 which extends substantially parallel to the plane of the outer rim 120 of this panel.

From FIG. 7 it will be evident that this panel engages the window pane only at the adhesive layer 125 on its peripheral rim 120, so it forms a single "dead" air pocket inside this rim. The slight angle of the panel segments 54–57 and the parallelism of the outer segment 58 to the plane of the window pane insure that there is very little optical distortion over most of the surface area of the panel, as seen by a person inside the building.

FIG. 6 shows panels of this type on a window pane large enough (with respect to the individual panels) to require twelve panels to completely cover the window pane. It is to be understood that the relative sizes of the window pane and the panels in FIG. 6 are illustrative only.

Figure 8:
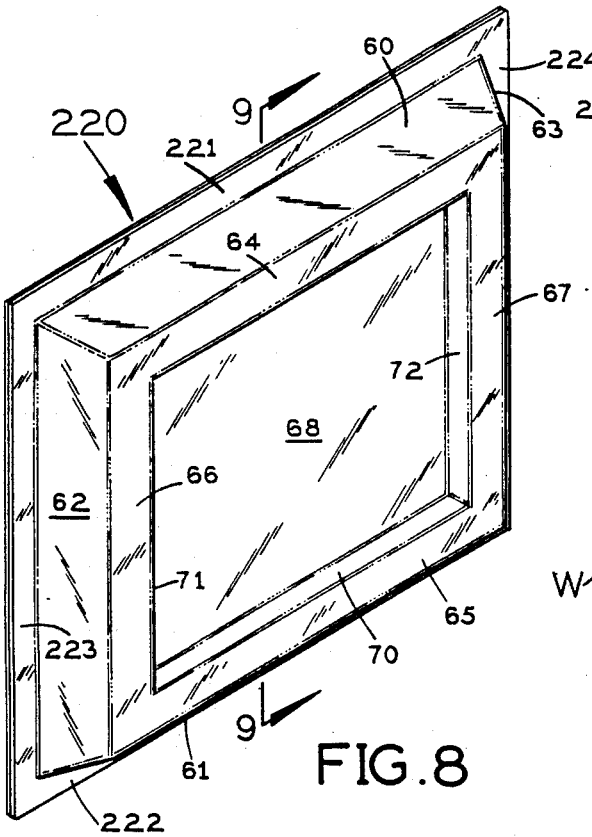
FIG. 8 is a perspective view of a third embodiment of the present panel.
Figure 9:
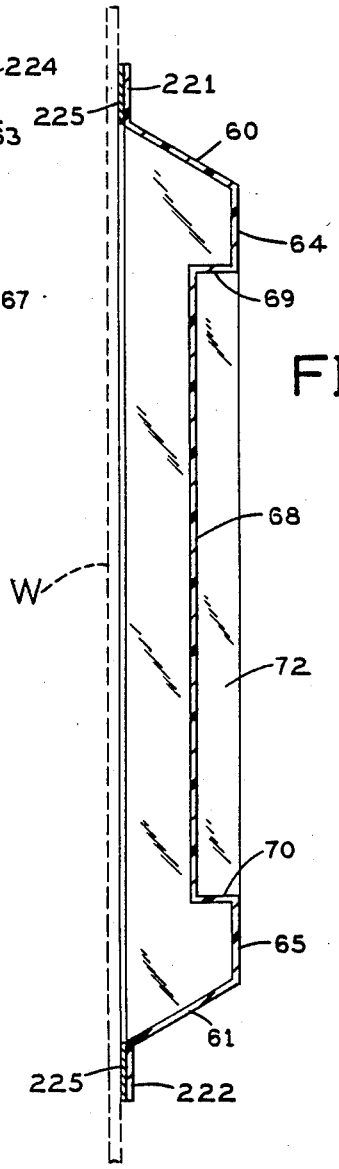
FIG. 9 is a vertical cross-section taken along the line 9—9 in FIG. 8.

FIGS. 8 and 9 show a third embodiment of the present panel. It has a flat peripheral rim 220 essentially the same as the rim of the first two embodiments. Elements of this rim in FIGS. 8 and 9 have the same reference numerals plus 200 as corresponding elements of the rim in the first embodiment shown in FIGS. 1–4 and already described in detail.

Just inward from the rim this panel presents an inclined flat upper segment 60 and an oppositely inclined flat lower segment 61, an inclined flat left side segment 62 and an oppositely inclined flat right-side segment 63. These inclined segments are joined respectively to the top, bottom, left and right side 221, 222, 223 and 224 segments of the periheral rim 220, and they extend laterally inward from the respective rim segments at a substantial acute angle to the plane of the rim, which may be 60 degrees or more, as shown in FIG. 9.

The inclined segments 60, 61, 62 and 63 are joined to a flat outer wall of rectangular outline, presenting horizontally elongated top and bottom segments 64 and 65 and vertically elongated opposite side segments 66 and 67. This flat outer wall of the panel lies in a plane extending parallel to the plane of its window pane-engaging peripheral rim 220.

Laterally inward from this outer wall the panel is recessed inwardly (i.e., toward the plane of its rim), presenting a flat central wall 68 having a rectangular periphery and lying in a plane parallel to the plane of the rim 220 and closer to it than the outer wall 64. Wall 68 is joined to the respective segments 64, 65, 66 and 67 of the outer wall by connecting segments 69, 70, 71 and 72 at the top, bottom and opposite sides. Each of these connecting segments lies in a plane perpendicular to the respective planes of the window pane-engaging rim 220, the outer wall 64–67, and central wall 68.

As is clear from FIG. 9, the entire panel is positioned on the opposite side of its peripheral rim 220 from the window pane W which the rim is sealed against in air-tight fashion by its adhesive layer 225. Thus the panel forms just a single pocket for holding "dead" air which is bounded by the window pane-engaging rim 220.

As seen by a person inside the building, all the surface area of the panel inside its inclined flat segments 60–63 is parallel to the plane of the window pane, so the panel provides very little optical distortion.

Figure 10:
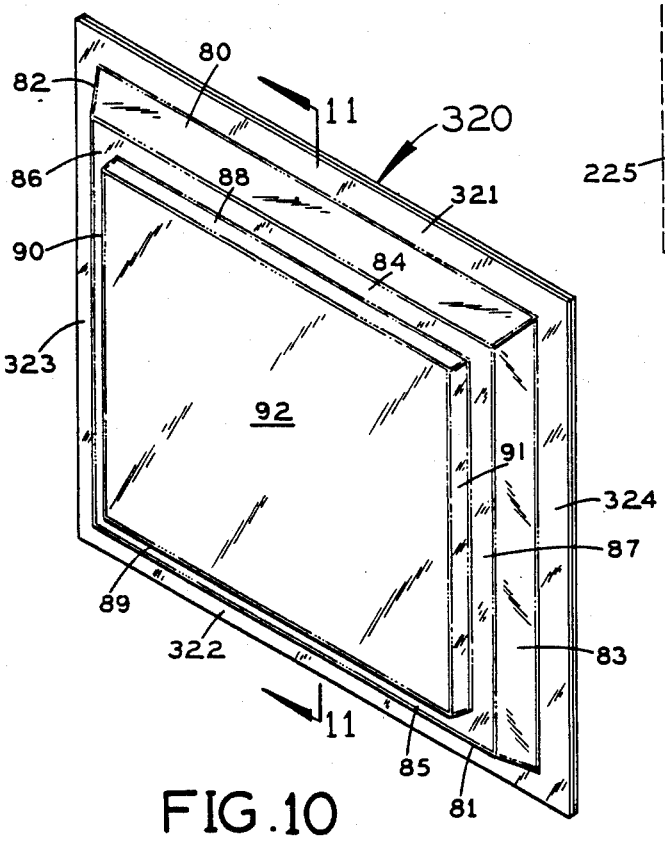
Figure 11:
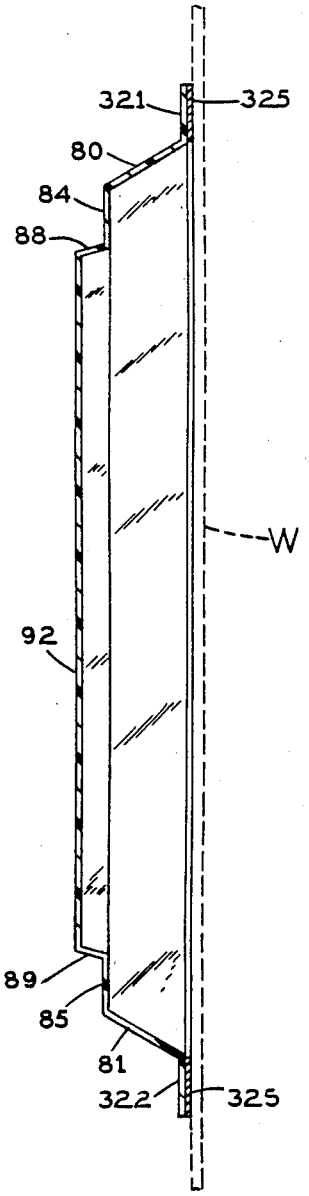
FIG. 11 is a vertical cross-section taken along the line 11—11 in FIG. 10.

In the fourth embodiment of the present invention, shown in FIGS. 10 and 11, the flat peripheral rim 320 is essentially like the rims in the previously described embodiments. Elements of this rim have the same reference numerals plus 300 as those in the first embodiment.

Just inward from this rim this panel presents an inclined flat upper segment 80 and an oppositely inclined flat lower segment 81, an inclined flat left-side segment 82 and an oppositely inclined flat right-side segment 83. These outer inclined segments are joined to the outer edges of corresponding flat segments 84, 85, 86 and 87, all lying in a plane parallel to the plane of the rim 320. At their inner edges, the coplanar segments 84, 85, 86 and 87 are joined to respective inclined connecting segments 88, 89, 90 and 91, which extend almost perpendicular to the coplanar segments 84, 85, 86 and 87. A flat central wall 92, which has a rectangular periphery and occupies most of the area covered by the panel, is joined to the inner edges of the connecting segments 88, 89, 90 and 91. Wall 92 lies in a plane parallel to the plane of the window pane-engaging rim 320 of the panel and farther away from it than the parallel plane of segments 84, 85, 86 and 87.

As shown in FIG. 11, its peripheral rim 320 is the only part of this panel that engages the window pane. All the rest of the panel is away from the window pane so that it forms a single "dead" air pocket that is bordered by the rim 320, which is sealed against the window pane in air-tight fashion by the adhesive layer 325.

The panel provides very little optical distortion because of the parallelism of its broad area central segment 92 and its segments 84–87 to the plane of the window pane.

Each of the disclosed embodiments of the invention has the advantage that it is adhesively attached to the window pane only along its own peripheral rim. This is sufficient to provide an adequate air-tight seal for the entire panel so that it provides a single dead air pocket across the portion of the window pane that it covers. This construction enables the panel to be put on the window pane quickly and with relative ease because only as much of the panel (i.e., the peripheral rim) is attached to the window pane as is absolutely necessary to provide the necessary seal.

While the invention has been described as used on a glass window pane it should be understood that it can also be used on a glass door pane.

I claim:

1. A protective panel of transparent material for a window pane comprising:

a peripheral rim having a planar inside face extending continuously over the entire extent of the rim along the periphery of the panel;

an adhesive layer covering said inside face of the rim for engagement with the window pane to attach the rim in substantially air-tight fashion to the window pane;

adjoining inclined flat segments joined to said peripheral rim along its entire length and extending laterally inward from the rim at a substantial angle to the plane of said inside face of the rim and projecting on the opposite side of the rim from said inside face, said inclined flat segments laterally inward from the rim presenting inner edges which form an inner border located laterally inward from said peripheral rim;

a plurality of discrete flat outer segments lying in a plane parallel to the plane of said inside face of the peripheral rim, said outer segments being joined to said inclined flat segments at said inner edges of the latter;

a plurality of flat inner segments positioned between said discrete outer segments and each extending from a corresponding one of said inclined segments to the middle of the panel, said inner segments lying in a plane parallel to the plane of said inside face of the rim and closer to the latter than the plane of said outer segments;

said outer and inner segments being joined to said inclined flat segments and forming corners therewith at said inner edges of said inclined segments;

and a plurality of connecting segments joining said inner segments to the neighboring outer segments.

2. A protective panel of transparent material for a window pane comprising:

a peripheral rim having a planar inside face extending continuously over the entire extent of the rim along the periphery of the panel;

an adhesive layer covering said inside face of the rim for engagement with the window pane to attach the rim in substantially air-tight fashion to the window pane;

adjoining inclined outer flat segments joined to said peripheral rim along its entire length and extending laterally inward from the rim at a substantial angle to the plane of said inside face of the rim and projecting on the opposite side of the rim from said inside face, said inclined outer flat segments laterally inward from the rim presenting inner edges which form an inner border located laterally inward from said peripheral rim;

a plurality of additional inclined inner flat segments connected directly to and extending laterally inward from the inner edges of said inclined outer flat segments at a substantially smaller angle than the latter to the plane of said inside face of the peripheral rim, said inclined inner flat segments presenting inner edges located laterally inward from said inner edges of the inclined outer flat segments;

and a flat outer segment extending between said inner edges of said inclined inner flat segments and lying in a plane parallel to the plane of said inside face of the rim.

3. A protective panel of transparent material for a window pane comprising:

a peripheral rim having a planar inside face extending continuously over the entire extent of the rim along the periphery of the panel;

an adhesive layer covering said inside face of the rim for engagement with the window pane to attach the rim in substantially air-tight fashion to the window pane;

adjoining inclined flat segments joined to said peripheral rim along its entire length and extending laterally inward from the rim at a substantial angle to the plane of said inside face of the rim and projecting on the opposite side of the rim from said inside face, said inclined flat segments laterally inward from the rim presenting inner edges which form an inner border located laterally inward from said peripheral rim;

a plurality of adjoining flat outer segments directly connected respectively to the inner edges of said inclined flat segments and lying in a plane parallel to the plane of said inside face of the peripheral rim;

a plurality of adjoining connecting segments connected respectively to said outer segments away from said inclined segments and extending from said outer segments toward the plane of said inside face of the rim;

and a flat central segment joined to said connecting segments away from said outer segments, said central segment extending parallel to the plane of said inside face of the rim and closer to the latter than the plane of said outer segments.

4. A protective panel of transparent material for a window pane comprising:

a peripheral rim having a planar inside face extending continuously over the entire extent of the rim along the periphery of the panel;

an adhesive layer covering said inside face of the rim for engagement with the window pane to attach the rim in substantially air-tight fashion to the window pane;

adjoining inclined flat segments joined to said peripheral rim along its entire length and extending laterally inward from the rim at a substantial angle to the plane of said inside face of the rim and projecting on the opposite side of the rim from said inside face, said inclined flat segments laterally inward from the rim presenting inner edges which form an inner border located laterally inward from said peripheral rim;

a plurality of adjoining coplanar segments directly connected respectively to the inner edges of said inclined flat segments and lying in a plane parallel to the plane of said face of the peripheral rim;

a plurality of adjoining connecting segments connected respectively to said coplanar segments away from said inclined segments and extending from said coplanar segments away from the plane of said inside face of the rim;

and a flat central segment joined to said connecting segments and lying in a plane parallel to the plane of said inside face of the rim and positioned farther from said plane of the inside face of the rim than said coplanar segments.

* * * * *